United States Patent [19]

Kanzaka

[11] Patent Number: 4,509,232

[45] Date of Patent: Apr. 9, 1985

[54] ATTACHING POST FOR SNAP FASTENER ELEMENTS

[75] Inventor: Yoshihiro Kanzaka, Nyuzen, Japan

[73] Assignee: Nippon Notion Kogyo Co., Ltd., Tokyo, Japan

[21] Appl. No.: 517,897

[22] Filed: Jul. 28, 1983

[30] Foreign Application Priority Data

Aug. 2, 1982 [JP] Japan ..... 57-117499

[51] Int. Cl.[3] ..... A44B 1/42

[52] U.S. Cl. ..... 24/113 R; 24/90 R; 24/90 E; 24/662; 24/689; 5/472; 411/462

[58] Field of Search ..... 24/113 R, 113 MP, 90 R, 24/90 B, 90 E, 92, 93, 94, 95, 96, 662, 689, 692, 703; 411/462; 5/472

[56] References Cited

U.S. PATENT DOCUMENTS

| | | | |
|---|---|---|---|
| 447,346 | 3/1891 | Pringle | 24/692 |
| 567,529 | 9/1896 | White et al. | 24/95 |
| 958,328 | 5/1910 | Serwer | 24/92 |
| 1,205,049 | 11/1916 | Snyder | 24/689 |
| 1,981,813 | 11/1934 | Schuster | 24/90 E |
| 2,014,699 | 9/1935 | Reiter | 24/692 |
| 2,261,285 | 11/1941 | Purinton | 24/90 E |
| 3,613,181 | 10/1971 | Taylor | 24/662 |
| 4,197,617 | 4/1980 | Appelt | 24/90 R |

FOREIGN PATENT DOCUMENTS

| | | | |
|---|---|---|---|
| 481726 | 3/1952 | Canada | 24/662 |
| 1034476 | 7/1953 | France | 24/113 R |
| 810266 | 3/1959 | United Kingdom | 24/662 |

*Primary Examiner*—Victor N. Sakran

*Attorney, Agent, or Firm*—Hill, Van Santen, Steadman & Simpson

[57] ABSTRACT

An attaching device for attaching a socket member of a snap fastener to a garment has a post having a circular flange extending from a cylindrical stem and a cap mounted thereon. The circular flange has a central portion, an intermediate inclined annular step, a radially outwardly extending annular shoulder, and a plurality of radial ribs extending radially outwardly from an end of the stem to the inclined annular step. The central portion of the flange has a surface adjacent to the inclined annular step which is held against a rounded wall of the cap. The end of the post is axially spaced from the rounded wall of the cap to provide a clearance therebetween. The annular shoulder of the flange is locked in position by an annular curled rim of the cap. Any impact force applied when the attaching device is staked on the socket member is distributed uniformly to the flange, preventing the cap from being deformed.

3 Claims, 6 Drawing Figures

ATTACHING POST FOR SNAP FASTENER ELEMENTS

BACKGROUND OF THE INVENTION

1. Field of the Invention

The present invention relates to an attaching device for attaching an element such as a socket member of a snap fastener to a material such as a garment, and more particularly to such an attaching device including a cap.

2. Description of the Prior Art

There are known attaching devices of the type described which include a hollow cylindrical stem having on one end a flange with a cap mounted theron. For mounting a socket member of a snap fastener on a garment, the other end of the cylindrical stem pierces the garment and then such other end of the cylindrical stem is deformed and staked on the socket member. When the end of the stem is to be staked on the socket member, a tool is employed to press the stem under an impact force applied axially toward the flange or cap. The impact force imposed on the stem, however, tends to deform the flanged end thereof which then results in undesirable deformations on the cap. The deformed cap on the socket member greatly reduces the commercial value of the snap fastener assembly mounted on the garment.

To solve such a problem, there has been devised an attaching device as disclosed in Japanese Laid-Open Utility Model Publication No. 56-174509 published Dec. 23, 1981. The disclosed attaching device comprises a post including a flange or an annular seat having a plurality of radial tongues cut out of the flange from an outer peripheral edge thereof toward the center. Each of the cutout tongues includes a first bent portion projecting toward a cap mounted on the flange and a second bent portion contiguous to the first bent portion and bent back toward the center over the first bent portion. The second bent portions have surfaces facing the cap and lying flush with the surface of the flange which confronts the cap. The attaching post also has a plurality of locking prongs held in axial alignment with the tongues. When the attaching post is to be attached to a socket member of a snap fastener across a garment material, the locking prongs are individually staked on the socket member with a force applied axially of the post. In such a deforming process, the bent tongues serve to take up the imposed force transmitted through the locking prongs. Therefore, if there were no such locking prongs axially aligned with the bent tongues, the applied force would deform the flange and hence the cap. Formation of the bent tongues and locking prongs on the flange has involved an increased number of manufacturing steps and resulted in expensive snap fasteners.

SUMMARY OF THE INVENTION

Accordingly, it is an object of the present invention to provide an attaching device for snap fastener parts which is simple in construction, can be manufactured with ease, and has a cap that will be free from deformations when the attaching device is staked on the snap fastener element.

According to the present invention, an attaching device for a snap fastener element such as a socket member has a post including a circular flange composed of a central portion, an intermediate inclined annular step, and a radially outwardly extending annular shoulder. A circular cap is mounted on the circular flange and includes a rounded wall and an annular rim integral therewith. The post also includes a cylindrical stem having an axial end from which the circular flange extends radially outwardly, the axial end of the cylindrical stem being axially spaced from the rounded wall of the cap. The central portion of the flange has an upper surface adjacent to the inclined annular step which is held against the rounded wall of the cap. The annular shoulder is locked in position by the annular curled rim of the circular cap. Any impact force applied when the attaching device is staked on the socket member is distributed uniformly to the flange, preventing the cap from being deformed. The annular step and shoulder and the ribs can easily be formed simply by pressing the flange.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
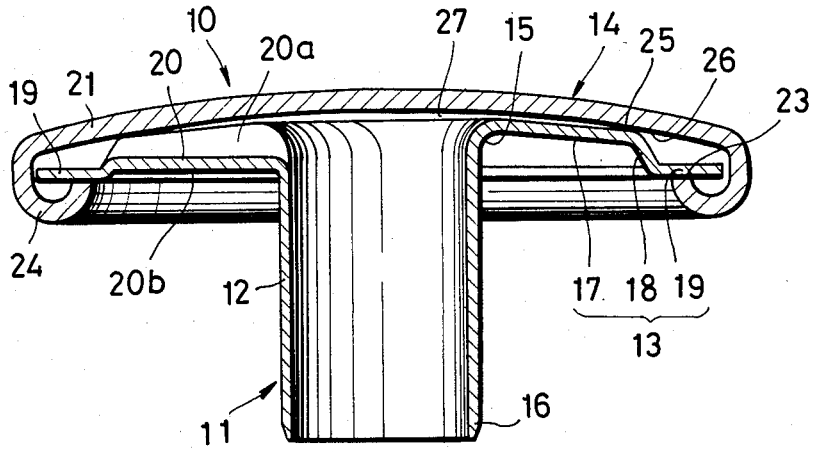
FIG. 1 is an axial cross-sectional view of an attaching device according to the present invention.

The principles of the present invention are particularly useful when embodied in an attaching device such as shown in FIG. 1, generally indicated by the numeral 10.

The attaching device 10 comprises a post 11 including a deformable hollow cylindrical stem 12 and a circular flange 13, and a circular cap 14 mounted on the circular flange 13. The flange 13 is integral with an axial end 15 of the cylindrical stem 12, the axial end 15 flaring radially outwardly and blending into the flange 13. The cylindrical stem 12 has an opposite tapered or bevelled end 16 which will be deformed and staked on a socket member (described later) of a snap fastener.

Figure 2:
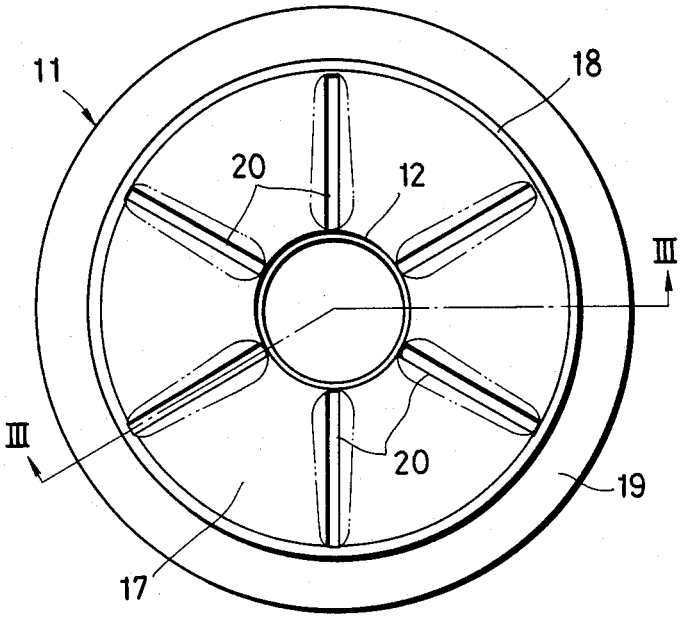
FIG. 2 is a plan view of a post of the attaching device shown in FIG. 1.
Figure 3:
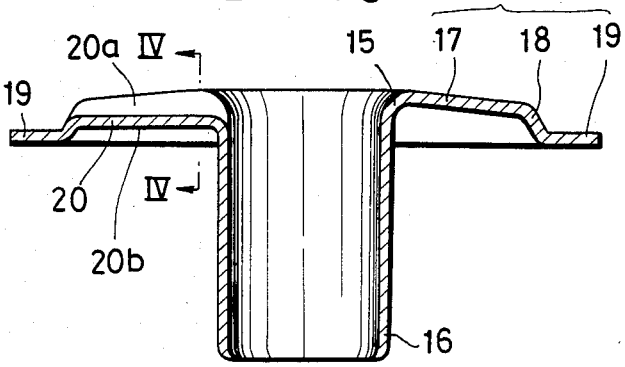
FIG. 3 is a cross-sectional view taken along line III—III of FIG. 2.

As illustrated in FIGS. 1 through 3, the circular flange 13 is composed of a slightly inclined, circular central portion 17 leading from the end 15 of the stem 12, an inclined annular or frustoconical step 18 extending radially outwardly and axially from the central portion 17, and an annular shoulder 19 extending radially outwardly from the annular step 18 in concentric relation thereto in a direction substantially perpendicular to the axis of the cylindrical stem 12.

Figure 4:
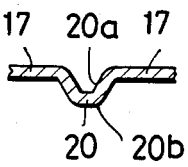
FIG. 4 is a cross-sectional view taken along line IV—IV of FIG. 3.

The circular flange 13 also includes a plurality of ribs 20 extending radially from the end 15 of the stem 12 to the annular step 18, the ribs being angularly spaced at equal angular intervals. The ribs 20 are formed by pressing portions out of the circular flanges 13 from the end 15 toward the end 16. Therefore, each of the ribs 20 provides a groove 20*a* opening toward the cap 14 and an opposite ridge 20*b* projecting toward the end 16 of the stem 12, as shown in FIGS. 3 and 4.

Figure 5:
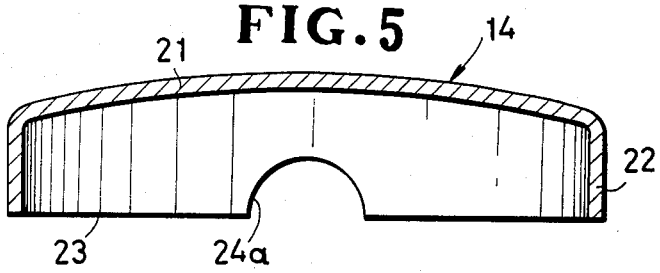
FIG. 5 is a cross-sectional view of a cap prior to being attached to the post.

As illustrated in FIG. 5, the cap 14 prior to being mounted on the flange 13 comprises a slightly rounded upper wall 21 and an annular flange 22 extending axially from an outer circumferential edge of the upper wall 21 and terminating in an edge 23. The annular flange 22 has a plurality of semicircular recesses 24A (one shown).

To attach the cap 14 to the flange 13, the cap 14 is first placed on the central portion 17 of the flange 13 with the annular shoulder 19 thereof flanked by the annular flange 22 of the cap 14. Then, the annular flange 22 is deformed as by a presser tool radially inwardly into a rolled or curled rim 24 until its edge 23 is firmly pressed against the annular shoulder 19, as shown in FIG. 1. The semicircular recesses 24A in the annular flange 22 serve to absorb and eliminate any large wrinkles which would otherwise be left on the curled rim 24. Therefore, the cap 14 is neatly mounted on the flange 13. With the cap 14 thus installed on the flange 13, the central portion 17 thereof has an upper surface 25 just above the annular step 18, held in contact with a lower surface 26 of the cap 14, and the annular shoulder 19 is locked in position by the edge 23 of the curled rim 24. The end 15 of the stem 12 is slightly spaced from the lower surface 26 of the cap 14, leaving a space or clearance 27 therebetween.

Figure 6:
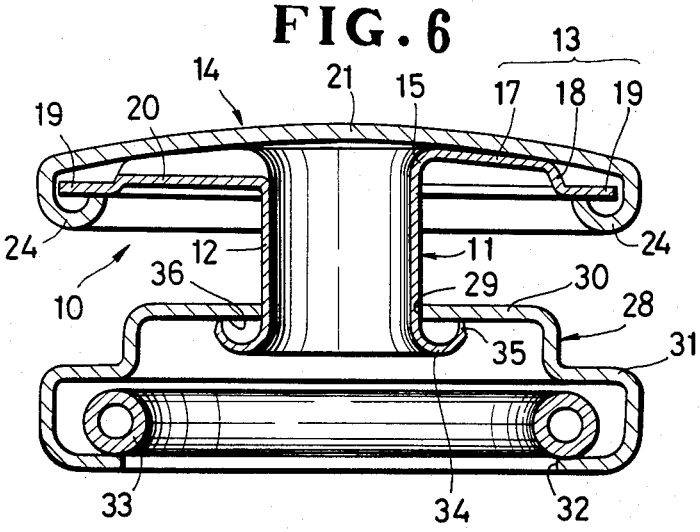
FIG. 6 is a cross-sectional view of the attaching device staked on a socket member of a snap fastener.

FIG. 6 illustrates the assembled attaching device 10 installed on a socket member 28 of a snap fastener. The socket member 28 includes a hollow retainer 30 integral with a hollow base 31. The hollow retainer 30 has a central aperture 29. The hollow base 31 also has a central opening 32 coaxial with the central aperture 29. The hollow base 31 houses therein a snap ring 33 running substantially along the peripheral edge of the central opening 32.

For attachment of the attaching device 10 to the socket member 28, the stem 12 pierces a material such as a garment (not shown) and enters the central aperture 29. Then, a hammer tool (not shown) of a known construction is introduced through the central opening 32 in the socket member 28 until the end of the hammer tool is held against the end 16 of the stem 12 projecting into the socket member 28. With the cap 14 backed up by a suitable support, the hammer tool is driven under an impact force toward the stem 12 until the end 16 thereof is spread radially outwardly into a curled flange 34 with its edge 35 biting into the wall of the retainer 30. The impact force applied by the hammer tool is transmitted axially through the stem 12 and acts on the flange 13 via the end 15. The radial ribs 20 on the flange 13 stiffen the latter to prevent any unwanted deformation thereof, particularly at the end 15, while distributing the applied impact force uniformly to the flange 13. Furthermore, since the annular shoulder 19 is locked by the curled rim 24 and supported by the annular step 18 against the cap 14 through the surface 25, the flange 13 is prevented from being deformed toward the socket member 28. The clearance 27 serves to take up axial displacement of the stem 12 under the impact force. Consequently, the cap 14 remains free from any undesirable deformations which would otherwise result from being hit by the stem 12 and the flange 13 under the impact force imposed thereon.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An attaching device for a snap fastener element, comprising:

(a) a post including a cylindrical stem and a circular flange integral therewith and extending from an end of said stem;

(b) a cap mounted on said flange and including a rounded circular wall and an annular curled rim integral with and extending axially from said rounded wall and having an end;

(c) said circular flange including a central portion contiguous to said end of said stem, an inclined annular step extending radially outwardly from said central portion, an annular shoulder extending radially outwardly from said annular step, and a plurality of radial ribs integral with said post and extending radially outwardly from said end of said stem to said annular step, said end of said stem being spaced from said rounded wall of said cap, and said annular shoulder being locked in position by said end of said annular rim.

2. An attaching device according to claim 1, each of said radial ribs having a groove opening toward said cap and a ridge projecting away from said cap.

3. An attaching device according to claim 1, said end of said axially extending rim extending about the periphery of said annular shoulder with the thickness of said end flatwise engaging a side of said annular shoulder facing away from said circular wall.

* * * * *